United States Patent [19]

Steward

[11] Patent Number: 4,621,676

[45] Date of Patent: Nov. 11, 1986

[54] CASTING OF METALLIC MATERIALS

[75] Inventor: Neil D. Steward, Slough, England

[73] Assignee: The Secretary of State for Trade and Industry in Her Britanic Majesty's Government of the United Kingdom of Great Britain and Northern Ireland, London, England

[21] Appl. No.: 582,473

[22] Filed: Feb. 22, 1984

[30] Foreign Application Priority Data

Feb. 23, 1983 [GB] United Kingdom ..... 8305066

[51] Int. Cl.[4] ..... B22D 11/124; B22D 11/10

[52] U.S. Cl. ..... 164/485; 164/122; 164/490

[58] Field of Search ..... 164/485, 486, 487, 122, 164/488, 489, 490

[56] References Cited

U.S. PATENT DOCUMENTS

| | | | |
|---|---|---|---|
| 3,902,544 | 9/1975 | Flemings et al. | 164/485 |
| 4,263,959 | 4/1981 | Flemings et al. | 164/485 |
| 4,315,538 | 2/1982 | Nielsen | 164/488 |
| 4,434,839 | 3/1984 | Vogel | 164/485 |

FOREIGN PATENT DOCUMENTS 0071822 2/1983 European Pat. Off. .

*Primary Examiner*—Francis S. Husar
*Assistant Examiner*—Steve Katz
*Attorney, Agent, or Firm*—Cushman, Darby & Cushman

[57] ABSTRACT

A process for casting molten metallic material having a solidification range of temperatures, especially alloys containing more than 80% aluminium, involves simultaneously stirring and cooling the molten material to a temperature between 0° C. and 75° C. above the liquidus temperature of the metallic material using hollow heat transfer rods (9) extending across a duct (4), down which the material is caused to flow. The material is then caused to solidify with a substantially non-dendritic microstructure by rapidly cooling it in a continuous casting machine. The solidified bar so produced may then be reheated at a steady rate to a point between its liquidus and solidus temperature until it contains between 30% and 70% by volume solids content but can still be maneuvered without losing its shape. It may then, with a minimum of delay, be rapidly formed into a solid article of any desired shape by, for example, casting in a pressure casting machine.

7 Claims, 3 Drawing Figures

1
2
3
4
4A
5
6
7
8
9
10
11
12
13
14
15
16
16'
17
18
19
20
II

CASTING OF METALLIC MATERIALS

This invention relates to a process for the casting of metallic materials, especially those such as metallic alloys, which exhibit a solidification range of temperatures. The invention is particularly applicable to the casing of aluminum alloys.

In such metallic materials the transition from wholly liquid to wholly solid state will take place between two temperatures, the liquidus temperature above which no solid phase is present, and the solidus temperature below which the material is wholly solid. Between these two temperatures the material comprises both liquid and solid phases.

When preparing a quantity of molten metallic material having a solidification range of temperatures for casting into solid form, it is common practice to maintain the temperature of the molten material considerably above its liquidus to prevent impurities in the molten material from precipitating out in the bottom of the container before the material is cast. If such a molten material is left undisturbed to cool, solid will first form at the periphery from which heat can escape and grow steadily inwards as further heat is extracted. The solid will grow in "branch-like" formations known as dendrites and for this reason such solidification is commonly termed dendritic growth.

It is known in the art that if such dendritic growth can be disrupted, and solidification made to take place around smaller, discrete nuclei, then the material produced possesses thixotropic properties. That is to say if such a material solidified in this way is reheated to a temperature above its solidus, it will retain a sufficient degree of rigidity throughout such that it can be easily and safely maneuvered and yet will flow readily when subject to an applied shearing force. Such properties are extremely desirable in a material to be used for casting. This is because, firstly the material is relatively viscous and so produces less splashing and turbulence, even when pressure cast. As the flow into the die is laminar there is less likelihood of air bubbles becoming entrapped within the material to produce imperfect, porous castings. Furthermore the material can be cast at temperatures well below the liquidus and thus the thermal shock to the die is considerably reduced. Also with much lower temperatures, the solidification time required is reduced leading to increased throughput.

In one prior art process, U.S. Pat. No. 3,902,544, as the material is cooled to below its liquidus temperature and dendrites start to form, it is vigorously agitated by augers rotating at between 100 and 1,000 rpm. The branched dendrites are thereby fractured into fragments which form the discrete particles that give the thixotropic properties. This process however, suffers from several intrinsic disadvantages. Firstly the process requires a long holding time whilst the vigorous agitation breaks up the dendrites, thereby adding considerably to the overall production time. Secondly the rapidly rotating augers require frequent and specialized maintenance necessitating repeated closedown of production. Additionally the rotating augers are liable to induce air bubbles to become entrapped in the material leading to poor quality, porous castings. Yet another important disadvantage with the process of U.S. Pat. No. 3,902,544 is that solidified material produced thereby must be maintained for a considerable time at elevated temperatures above its solidus before the thixotropic properties are achieved, which causes the particles to coarsen considerably. This in turn causes the material when reheated to above its liquidus to be highly viscous and so it will not flow readily when subjected to an applied shearing force. It can also give rise to poor surface finishes on articles cast from this material.

These disadvantages are overcome by the process and apparatus of the applicants European Pat. No. 0013076. In this process the flow of molten material is interrupted by a plurality of static stirring elements, which cool the material to be a temperature below its liquidus whilst introducing a degree of turbulence to prevent the formation of dendritic growth. The process seeks to obtain thixotropic properties not by breaking up dendritic growth but by encouraging the formation of spheroidal nuclei rather than dendritic growth.

The present invention is an improvement on the process and apparatus of EP No. 0013076, which improvement allows the production of even more reliable and higher quality castings.

According to the present invention there is provided a process for casting a metallic material of the type that exhibits a solidification range of temperatures comprising:

(a) directing a flow of molten metallic material into a cooling duct that has therein one or more static elements that are adapted to produce turbulence in a material flowing through and out of the duct, at least one of the elements also being a thermal conductor and thereby further adapted to abstract heat from a material flowing through the duct, (b) allowing the flow of molten metallic material to flow through and out of the duct at such a rate that the temperature of the molten metallic material flowing out of the duct is between 0° C. and 75° C. above the liquidus temperature of the metallic material, and (c) rapidly cooling the molten metallic material flowing out of the duct at such a rate that the metallic material solidifies to form a solid metallic material with a substantially non-dendritic microstructure.

Preferably the rate of flow of the molten material through the duct is such that the material flowing out of the cooling duct is cooled to a temperature less than 50° C. above the liquidus of the material. Most preferably, the rate is such that the material flowing out of the cooling duct is cooled to a temperature between 5° C. and 40° C. above the liquidus of the material.

Unlike the process of the applicants European Patent previously described, in which the material in the cooling duct is cooled such that a solid phase is precipitated, in the process of the present invention the material is still fully molten as it leaves the duct. As the material leaving the cooling duct is fully molten it is less viscous than the semi-solid slurries produced previously. There is therefore less likelihood of difficulties arising in maintaining a constant feed to the casting means. The temperature control of semi solid slurries is both critical and difficult as any inadvertent lowering of temperature causes excessive solidification leading to breakdown of the supply of slurry to the casting means. With the fully molten feed of the present process the temperature control is less critical and a regular supply easier to maintain. For these reasons the process of the invention is particularly suited to a continuous casting process.

Whilst the temperature of the molten material passing out of the duct must be above the liquidus temperature, it must also be less than 75° C. above the liquidus temperature. This is because when molten material at more than 75° C. above its liquidus temperature is rapidly cooled by a conventional casting means after passing out of the duct, it is found that the material solidifies through its body with a non-homogenous grain structure which typically consists of a very fine grain structure surrounding an interior of large columnar grains extending towards the center of the material.

It had not heretofore been appreciated that dendritic growth could be inhibited by cooling a material from above its liquidus without stirring or agitation. Previously all the processes have attempted to treat the material, eg with the vigorous agitation of U.S. Pat. No. 3,902,544, whilst within its solidification range (ie with a solid phase present). The surprising success of the present invention is achieved by the combinatin of three advantageous effects of the process. Firstly the one or more static elements mix the material such that its temperature is substantially the same across any plane perpendicular to the direction of flow. Thus the molten material is substantially homogenous when it leaves the cooling duct. Secondly the static elements ensure that there remains a degree of turbulence in the material as it leaves the cooling duct so that turbulence persists into the solidification zone. Thirdly the solidification stage of the process is carried out rapidly but evenly across the direction of flow causing the material to be "frozen" with a generally equiaxed rather than dendritic microstructure.

After solidification, the metallic material may be reheated to a temperature within its solidification range, until the material contains a solid phase of between 30% and 70% (by volume) preferably 40% to 60% (by volume), and then immediately subjected to a secondary forming operation. The secondary forming operation may comprise extrusion, closed die forging or squeeze forging, but preferably comprises casting in a pressure casting machine.

The temperature of the solidified material is preferably increased steadily during reheating, to a temperature at which the percentage of solid phase present will be in the required range. Any desired rate of reheating may be employed up to the solidus temperature of the material because reheating to this temperature does not appear to have any substantial effect on the microstructure of the solidified material. However, it is important that reheating above the solidus temperature is carried out at a sufficiently high rate to prevent undue coarsening of the non-dendritic microstructure which effect occurs when solid and liquid phase are present together in the material for prolonged periods of time. For example, where the material comprises an alloy containing at least 80% aluminium, the reheating rate above the solidus temperature should be at least 0.5° C. per minute. For the same reason, the material should be subjected to secondary forming immediately after the desired temperature is reached. It is not necessary to hold the material for a period of time at constant temperature above its solidus as heretofore believed. The material once reheated will then possess the desired properties of being rigid enough to be safely maneuvered to the secondary forming machine, and, at the same time, sufficiently thixotropic to be easily sheared by the machine to form an article of the desired shape.

The maximum rate for reheating above the solidus is normally set by the maximum rate at which the body of the material can be reheated without any part of the body over-melting and so losing its rigidity. The maximum rates achievable in conventional furnaces may be restricted to relatively low rates because, as the body receives all its heat by conduction through its exposed surfaces, localised overheating of these surfaces can occur. Alternatively, therefore, reheating may be carried out in an induction furnace, conveniently a medium frequency (2–5 kHz) induction furnace, where the size of the body permits. In an induction furnace the metallic material can be reheated above its solidus temperature at much higher rates than in a conventional furnace without localised over-melting occuring. By employing high reheating rates, grain coarsening can be more effectively suppressed.

In one convenient arrangement for the performance of the present process, the walls of the cooling duct are formed from a heat insulating material. This helps to ensure that the cooling of the material, as it moves along the duct is as homogeneous as possible. The insulating walls minimise heat loss from the duct and ensures that the majority of the heat extracted from the material is via the at least one thermal conductor.

Conveniently the one or more static elements extend transversely across the duct. This produces turbulence in the material flowing through the duct and thereby ensures that the material in the duct is efficiently mixed. Additionally, in the case of the at least one element which is a thermal conductor, heat is extracted evenly from right across the section of the flow of material. In one convenient arrangement, the one or more static elements are in the form of rods. At least one of these one or more rods is preferably positioned as close as practically possible to the inlet of the casting means to ensure that turbulence induced by the rod persists into the solidification zone.

It is necessary to ensure that the heat extracted from the material by the at least one element which is a thermal conductor is efficiently shed. Conveniently the at least one element extends without the duct so as to provide an external cooling surface. There may be provided fins or vanes outside the duct to assist in the shedding of heat. Alternatively the at least one element is hollow and is adapted to circulate a coolant there through. The provision of a plurality of elements which are thermal conductors, each with an adjustable supply of coolant enables very accurate control of the temperature of the material to be possible.

According to a further aspect, the invention resides in an article formed by a method incorporating a process as herein described. The article is conveniently in the form of a bar suitable for use as feed for a secondary forming apparatus, for example a die casting machine, a squeeze forging machine, an extrusion machine, or a closed die forging machine.

The invention will now be further described, by way of example only, with reference to the accompanying drawings in which, FIG. 1 is a sectional view of apparatus suitable for carrying out the process of the present invention.

Figures 1, 2:
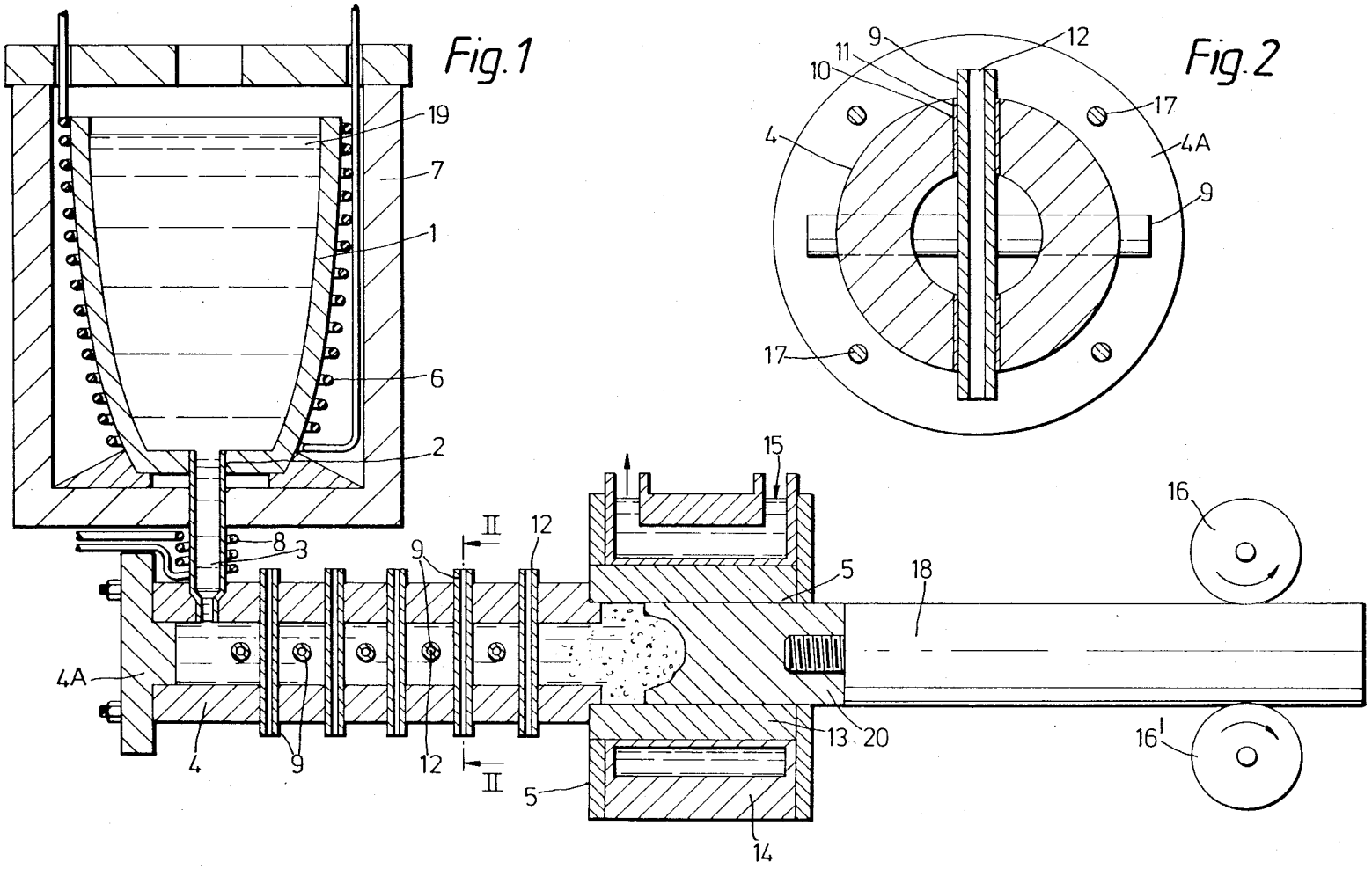
FIG. 2 is a sectional view along the line II—II of FIG. 1.

The apparatus of FIG. 1 comprises a vessel 1 for holding molten material, the vessel having an outlet 2 through which it communicates with the upper end of a short down pipe 3. At its lower end the down pipe opens into a cooling duct 4. The cooling duct is substantially horizontally disposed and opens at the end farthest from the down pipe into a die 5 forming part of a continuous casting machine.

The holding vessel 1 is heated by radiant elements 6 so as to maintain its charge at the desired temperature and is enclosed in a chamber shown somewhat schematically at 7 to prevent it being subject to draughts. The down pipe is also preferably heated at least initially during a casting run so as to prevent the molten material first entering the down pipe from freezing. A coiled heater element 8 may be used for this purpose.

The cooling duct 4 is provided with a number of static elements in the form of transversely disposed rods 9 passing through apertures 10 drilled in the duct walls (FIG. 2). The rods are sealed into the apertures by a layer of cement 11. The rods are hollow, having a passageway 12, through which a coolant can be circulated by means not shown in the drawings. Alternate rods are mutually disposed at right angles.

The cooler die 5 of the continuous casting machine comprises an annular graphite block 13 aligned with the end of the cooling duct and into which the end of the duct projects slightly, making a tight fit with the block. The cooling duct 4 is held firmly to the block of the continuous casting machine by means of tie bars 17 secured to the block 13 at one end and at their other ends passing through apertures in the end plate 4A of the cooling duct and carrying nuts on a threaded portion which can be tightened against plate 4A. To allow for linear expansion of the duct in use, springs are provided between each nut and the face of the end plate 4A. The block 13 of the continuous casting machine is surrounded by an annular water jacket 14, eg of copper, shrink fitted to the graphite block for good thermal contact and provided with inlet and outlet so that a stream of cooling water 15 can be circulated there through. The continuous casting machine also has a pair of pinch rollers 16, 16', arranged in line with the aperture in the die 5 and driven by an electric motor, not shown.

In use, the cooling water circulation through the jacket 14 is started and a starter bar 18 inserted into the aperture in the die 5. The rear end of the bar engages between pinch rollers 16, 16'. The down pipe feeder 8 is switched on and the pipe heated up to an appropriate temperature. A molten metal alloy 19 having a solidification range of temperatures is poured into the holding vessel 1 through a hatch (not shown) in the top of the chamber 7, and after a delay which is calculated or measured in a calibration run, the supply of coolant (if any) to the cooling/stirring rods is commenced and the rollers 16, 16' are started to turn, thus drawing the starter bar out of the die and away from the cooling duct 4. As the molten metal 19 passes along the duct 4 turbulent flow is induced by the rods 9 and heat is extracted evenly across the flow. As the metal passes the last of the rods and exits from the cooling duct, its temperature has been reduced to a little above its liquidus temperature. The molten material then passes into the cooler die 5 where rapid cooling takes place producing solidified material 20. The resulting solidified material 20 attaches to the starter bar 18 and is steadily withdrawn thereby until the solidified material itself is engaged between the pinch rollers 16, 16'. After this point is reached the starter bar may be detached from the solid material though this is preferably done by first cutting off the end portion of the solidified material together with the bar and then either melting the material off the bar or otherwise removing it.

Figure 3:
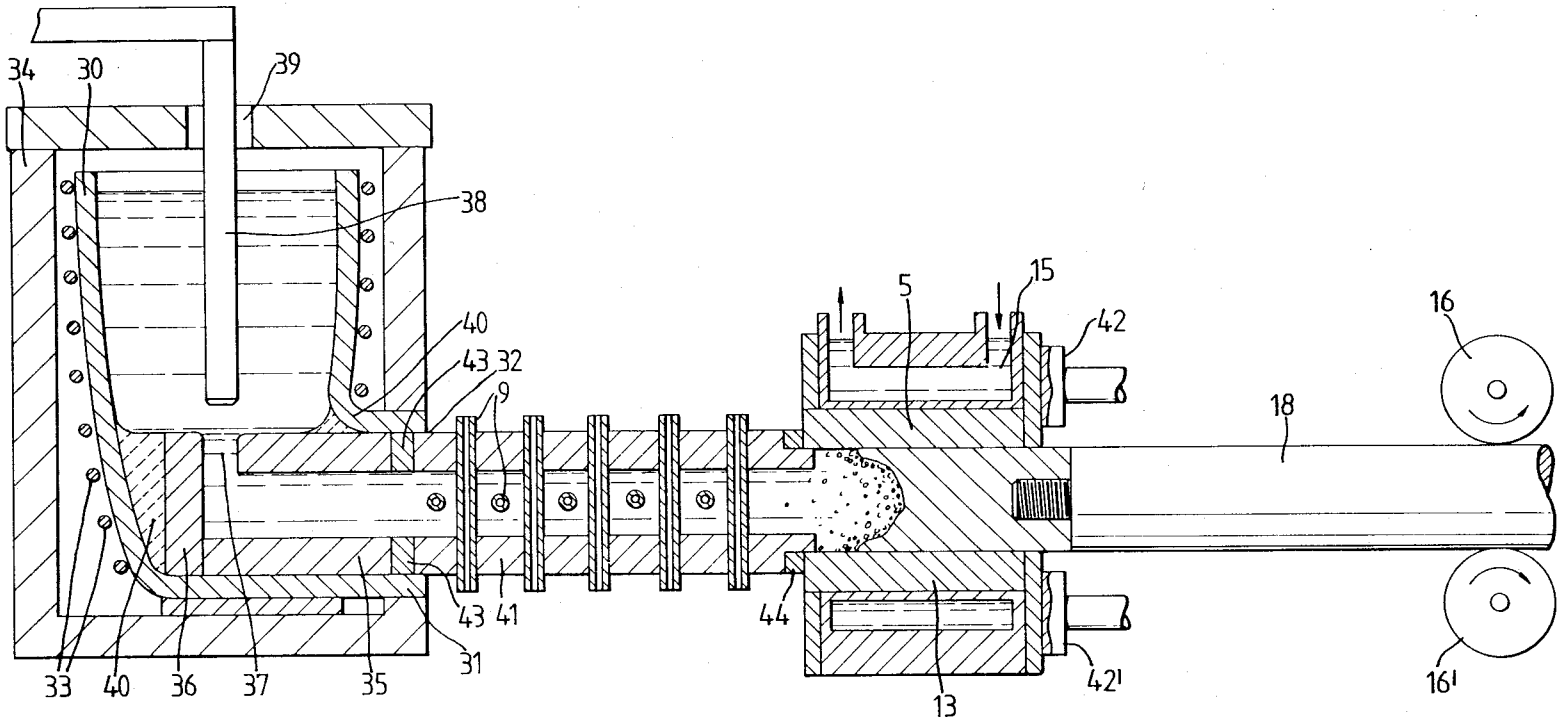
FIG. 3 is a sectional view of an apparatus similar to that illustrated in FIG. 1 and also suitable for carrying out the process of the present invention.

The apparatus of FIG. 3 is similar to that of FIGS. 1 and 2 but with certain modifications. The apparatus consists of a vessel 30 for holding molten metal, which opens out horizontally at its lower end into a circular outlet 31 hwaving a mouth 32. The holding vessel 30 is heated by radiant elements 33 so as to maintain its molten charge at the desired temperature, and is enclosed in a chamber shown somewhat schematically at 34 to prevent it being subject to draughts. The outlet 31 of the vessel 30 passes through the sidewalls of the chamber 34.

Coaxially disposed within the vessel outlet 31 is a short tubular transfer duct 35 which is closed at one end by a blank 36 and which terminates at the other end, just inside the mouth 32 of the vessel outlet 31. The transfer duct 35 has a port 37 formed through its sidewalls adjacent the blank 36. The port 37 faces upwards in the vessel 30 and is closable by a plug 38 which extends upwards through the vessel 30 and out through an opening 39 in the top of the chamber 34. The plug 38 may be raised or lowered either manually or by machinery (not shown) to open or close the port 37. The transfer duct 35 is held firmly in the bottom of vessel 30 by means of cement 40 which is disposed about the duct up to the level of the port 37.

The apparatus illustrated in FIG. 3 includes a tubular cooling duct 41, similar to the cooling duct 4 illustrated in FIG. 1, and a cooler die 5 identical to that illustrated in FIG. 1. The tubular cooling duct 41 and the cooler die 5 are held against and in a horizontal, axial alignment with the open end of the transfer duct 35 by means of hydraulic rams shown schematically at 42, 42' which act against the die 5 toward the vessel 30. Between the transfer duct 35 and the cooling duct 41 is disposed a first annular gasket 43, and between the cooling duct 41 and the cooler die 5 is disposed a second annular gasket 44. By employing the rams 42, 42' and the gaskets 43 and 44, the cooling duct 41 and cooling die 5 may be easily and quickly disassembled from the vessel 30 for draining, cleaning, and general maintenance purposes. The cooling duct 41 is identical to that section of the cooling duct 4 of FIG. 1 between the downpipe 3 and die 5, and contains the same configuration of rods 9. As with the apparatus of FIG. 1, the apparatus of FIG. 3 also includes a pair of pinch rollers 16, 16' driven by electric motors (not shown), which are arranged in line with the cooling duct 41 and die 5.

The solidified bar produced by the apparatus of FIGS. 1 and 2 or FIG. 3 may then be cut or sheared into billets (not shown) which may be used as feed for a re-heating furnace and a secondary forming machine such as a pressure casting machine.

As illustration of actual operating conditions for the process of the invention, apparatus of the type generally described and illustrated hereinbefore which was designed for the casting of aluminium alloy will now be described by way of example only.

The apparatus of FIGS. 1 and 2 was used to perform the process of the present invention described in Example 1 below. The duct 4, vessel 1, and downpipe 3 were constructed of GC50 refractory ceramic material which is a silica fibre strengthened aluminia composition The duct was 675 mm long with an internal diameter of 38 mm and a minimum wall thickness of 29 mm. Disposed across the duct 4 were ten hollow graphite cooling rods 9, each 96 mm long and of 5 mm internal diameter and 15 mm external diameter. The rods were disposed perpendicular to the axis of the duct with alternative rods at right angles to each other and were each spaced apart longitudinally of the duct by 20 mm. The rods were connected to an air supply line so that a controlled volume of air could be blown through them by means of flexible hoses (not shown) terminating in copper tubes which fitted tightly onto the ends of the rods 9. The tenth rod 9 was positioned 6 cm from the end of the duct 4 farthest from the downpipe 3. The graphite block 13 had a thermal conductivity of 84 W/m/°C., a length of 19 cm and a thickness of 1 cm, and was designed to produce bar of 59 mm diameter.

The apparatus of FIG. 3 was used to perform the processes of the present invention described in Examples 2 and 3 below. The vessel 30, transfer duct 35, blank 36, cement 40, and cooling duct 41 of the apparatus of FIG. 3 were constructed of GC50 refractory ceramic material. Both the transfer duct 35 and the cooling duct 41 had an internal diameter of 38 mm and a minimum wall thickness of 29 mm. The length of the cooling duct was 600 mm. The size, number and arrangement of the rods 9, and their connection to the air supply, was identical to that described above in the apparatus used in the process of Example 1. The tenth rod 9 was positioned 6 cm from the end of the duct 41 abutting the cooler die 5. The first gasket 43 and second gasket 44 were both of a refractory material similar to GC50.

EXAMPLE I

Molten aluminium alloy LM21 to British Standard Specification (BS)1490, which contained nominally by weight 6% Si, 4% Cu, 1% Zn and the remainder aluminium was supplied to the holding vessel 1 where it was maintained at a temperature of 700° C. Alloy of this type has a solidification range of from 615° C. to 525° C. The molten alloy was allowed to pass freely through the outlet 2 and into the duct 4.

Air was blown at a pressure of 70 kPa through the eighth, ninth and tenth rods only. The temperature of the alloy measured just down stream of the tenth rod was 625° C., some 10° C. above the liquidus temperature for the alloy. The flowrate of cooling water through the die 5 was set at 3 $m^3$ per hour. In the present run the casting rate was 325 mm per minute withdrawn by the rollers 16, 16' in a continuous series of repeating cycles, each cycle consisting of a 10 mm withdrawal stroke followed by a 1 mm reverse stroke and a 1 second rest period.

The bar was then cut into billets weighing 900 g and was fed into a reheating furnace such that one billet would be ready every 30 seconds. The billets were heated at a rate of 20°-25° C. per minute up to 525° C. and then at a rate of 0.5° to 1° C. per minute up to 580° C. which is equivalent to approximately 40% solid volume content. Each billet so heated, still rigid at this solids content, was then transferred straight to a die casting machine. The die of the pressure casting machine had been pre-heated to 245° C. and the billet transferred to the machine was injected into the die with a fast shot rate of 450 cm/sec and an intensified pressure of 31 MPa applied immediately thereafter. The thixotropic billet was easily sheared and flowed into the die to form the cast article. The cast article was found to have a good surface furnish substantially free of imperfections, and was found to have a porosity of less than 1% by volume.

Alloy bar cast in accordance with Example 1 was found to have a non-dendritic microstructure consisting of discrete solid globular particles of about 50 microns average particle size dispersed in a solid matrix. A billet reheated to 580° C. in accordance with the above procedure and then quenched was found to have retained its non-dendritic microstructure, although the globular particles were observed to have grown to an average size of about 200 microns.

EXAMPLE 2

Molten aluminium alloy LM 25 to BS 1490, which contained nominally by weight 7% Si, 1% Mg, and the remainder aluminium was supplied to the holding vessel 30 with the plug 38 in a closed position over the port 37, where it was maintained at a temperature of 750° C. Alloy of this type has a solidification range of from 620° C. to 530° C. With the water supply to the cooler die 5 set at a flowrate of 3 $m^3$ per hour, the starter bar 18 was placed in position between the rollers 16, 16' and within the die 5, and the plug 38 was raised to admit the molten alloy into the ducts 35 and 41. As the molten alloy flowed into the cooler die 5 and began to solidify against the starter bar 18, the pinch rollers 16, 16' were activated to start withdrawing the starter bar 18 and thence the solidified alloy from the die 5. Air was blow down the eight, ninth and tenth rods 9 from the vessel 30 at a pressure of 210 kPa, and the airflow was adjusted such that the temperature of the alloy measured just downstream of the tenth rod was 635° C., some 15° C. above the liquidus temperature for the alloy. The pinch rollers 16, 16' were set to withdraw 280 mm per minute of 59 mm diameter cast bar in a continuous series of repeating withdrawal cycles, each cycle consisting of a 10 mm withdrawal stroke followed by a 0.5 mm reverse stroke and a 1 second rest period. Once casting had started, the molten alloy in the vessel 30 was allowed to cool to 700° C. and was thereafter maintained at that temperature, the air flowrate through the rods 9 being adjusted accordingly to keep the temperature of the alloy just downstream of the tenth rod at 635° C.

The level of the molten alloy in the vessel was periodically topped up as required. To stop the casting run, the plug 38 was closed over the port 37, the rollers 16, 16' were brought to a halt, the rams 42, 42' were released, and the cooling duct 41 and cooler die 5 disassembled to allow the remaining molten alloy contained in them to drain away.

The bar was then cut into billets weighing 600 g, and was fed into a reheating furnace such that one billet would be ready over 30 seconds. The billets were reheated at a rate of 20°-25° C. per minute up to 525° C., and thereafter at a rate of 1° C. per minute up to 575° C. which is equivalent to approximately 50% solid volume content. Each still-rigid billet was then transferred from the furnace to a die casting machine without delay. The die of the pressure casting machine had been pre-heated to 220° C. and the billet transferred to the machine was injected into the die with a fast shot rate of 450 cm/sec and an intensified pressure of 31 MPa applied immediately thereafter. The thixotropic billet was easily sheared and flowed in to the die to form the cast article. The surface quality and porosity of the article were found to be similar to that produced by the process of Example 1.

Alloy bar cast in accordance with Example 2 was found to have a non-dendritic microstructure consisting of discrete solid globular particles disposed in a solid matrix. A billet reheated to 575° C. in accordance with the above procedure and then quenched was found to have retained its non-dendritic microstructure, although some growth in particle size was observed.

EXAMPLE 3

Aluminium alloy LM 2014 to BS 1490, which contained nominally by weight 4% Cu, 1% Si, 1% Mg and the remainder aluminium was cast into bars using the apparatus illustrated in FIG. 3 and described above. Alloy of this type has a solidification range of 610° C. to 530° C., and the process employed to cast it into bar was identical to that described in Example 2 above except that the airflow in the rods 9 were adjusted such that the temperature of the molten alloy just downstream of the tenth rod was 650° C. some 40° C. above the liquidus.

The bar was then cut into billets, reheated, and cast into articles using a pressure casting machine, using the same procedure outlined in Example 2 above except that the billets were reheated in a medium frequency (2 to 5 kHz) induction furnace rather than a conventional furnace. The individual billets were reheated at a rate of 100° C. per minute up to 525° C., and thereafter at 5° C. per minute to 602° C. which is equivalent to approximately 50% by weight solid volume content. The surface quality and porosity of the article were found to be similar to that produced by the process of Example 1.

Alloy bar cast in accordance with Example 3 was found to have a non-dendritic microstructure consisting of discrete solid globular particles dispersed in a solid matrix. A billet reheated to 602° C. by the above procedure and then quenched was found to have retained the non-dendritic microstructure, although some growth in the size of the particles was observed.

I claim:

1. A process for casting a metallic alloy material of the type that exhibits a solidification range of temperatures comprising:

(a) directing a flow of a molten metallic material into a cooling duct that has therein one or more static elements which are arranged to lie across the path of the flow, at least one of the elements being a thermal conductor;

(b) allowing the flow of molten material to flow through and out of the duct at a rate sufficient to cause turbulence in the flow as it passes the one or more static elements;

(c) cooling the flow within the duct by abstracting heat from the at least one element that is a thermal conductor at a rate such that the temperature of the molten metallic material flowing out of the duct is between 0° C. and 75° C. above the liquidus temperature of the metallic material; and (d) rapidly cooling the molten metallic material flowing out of the duct at such a rate that the metallic material solidifies to form a solid metallic material with substantially non-dendritic, rounded microstructure which when reheated to within its solidification range of temperatures exhibits thixotropic properties.

2. A process according to claim 1 wherein the temperature of the molten metallic material flowing out of the cooling duct is between 0° C. and 50° C. above the liquidus temperature of the material.

3. A process according to claim 2 wherein the temperature of the molten metallic material flowing out of the cooling duct is between 5° C. and 40° C. above the liquidus temperature of the material.

4. A process according to claim 1 further comprising the subsequent steps of reheating the solid metallic material to a temperature within the solidification range of the metallic material, until the metallic material contains between 30% and 70% by volume of a solid phase, and immediately subjecting the solid phase containing metallic material to a secondary forming operation.

5. A process according to claim 4 wherein the solid metallic material is reheated until the metallic material contains between 40% and 60% by volume of a solid phase.

6. A process according to claim 1 wherein the metallic material is an aluminium alloy.

7. A process according to claim 6 wherein the metallic material is an alloy containing at least 80% by weight aluminium and further wherein the solid metallic material is reheated, above its solidus temperature, at a rate of at least 0.5° C. per minute.

* * * * *